US009540138B2

(12) United States Patent
Dubois et al.

(10) Patent No.: US 9,540,138 B2
(45) Date of Patent: Jan. 10, 2017

(54) COLLAPSIBLE TRANSPORT AND STORAGE CONTAINER

(75) Inventors: Jean-Marc Dubois, Engelberg (CH); Yves Hug, Lieli (CH)

(73) Assignee: GEORG UTZ HOLDING AG, Bremgarten (CH)

( * ) Notice: Subject to any disclaimer, the term of this patent is extended or adjusted under 35 U.S.C. 154(b) by 1183 days.

(21) Appl. No.: 12/999,536

(22) PCT Filed: Jun. 8, 2009

(86) PCT No.: PCT/IB2009/052412

§ 371 (c)(1),
(2), (4) Date: Mar. 11, 2011

(87) PCT Pub. No.: WO2009/153694

PCT Pub. Date: Dec. 23, 2009

(65) Prior Publication Data

US 2011/0174809 A1 Jul. 21, 2011

(30) Foreign Application Priority Data

Jun. 17, 2008 (CH) ..... 922/08

(51) Int. Cl.
*B65D 6/18* (2006.01)
*B65D 43/16* (2006.01)

(52) U.S. Cl.
CPC ..... *B65D 11/1833* (2013.01); *B65D 43/163* (2013.01); *B65D 43/166* (2013.01); *B65D 2211/00* (2013.01)

(58) Field of Classification Search
CPC ..... B65D 19/18; B65D 2519/00875; B65D 2519/009; B65D 11/1833; B65D 2211/00; B65D 43/163
(Continued)

(56) References Cited

U.S. PATENT DOCUMENTS 1,003,107 A * 9/1911 Heyman ..... 220/6
3,443,726 A * 5/1969 Godsted et al. ..... 222/80
(Continued)

FOREIGN PATENT DOCUMENTS

DE 295 01 696 U1 3/1995
DE 197 13 691 A1 10/1998
(Continued)

*Primary Examiner* — Stephen Castellano
(74) *Attorney, Agent, or Firm* — Henry M. Feiereisen LLC

(57) ABSTRACT

The invention relates to a plastic collapsible storage and transport container comprising a bottom part (2) with four collapsible sidewalls (3, 4) arranged in an articulated manner on the bottom part (2). Two opposing first sidewalls can be detachably engaged with the two other opposing second sidewalls (4) The container (1) also comprises a cover (5) and means for sealing (56) the cover to the container in a fixed manner. The bottom part (2) formed by a bottom frame (15) and a bottom plate (16) comprises at least two inwardly open and outwardly closed recesses (19) along each frame side (17, 18), said recesses having lateral boreholes extending parallel to the frame sides (17, 18) of the bottom frame (15). Said recesses (19) are used to receive molded parts (21) formed on the first and second sidewalls (3, 4), provided with lugs (22) extending parallel to the lower edges of the sidewalls (3, 4). Said lugs (22) can be inserted into the lateral boreholes (20) of the recess (19) and rotated therein in such a way that they form a hinge-type connection between the bottom part (2) and the sidewalls (3, 4). The cover is formed by two cover halves (5) connected to opposite sidewalls (4) of the container (1) by means of cover hinges (7).

13 Claims, 5 Drawing Sheets

(58) Field of Classification Search
USPC ..... 220/691, 7
See application file for complete search history.

(56) References Cited

U.S. PATENT DOCUMENTS

| | | | | | |
|---|---|---|---|---|---|
| 3,937,363 | A * | 2/1976 | Anderson | ..... | 222/105 |
| 4,181,236 | A * | 1/1980 | Prodel | ..... | 220/6 |
| 5,467,885 | A * | 11/1995 | Blinstrub | ..... | 220/6 |
| 5,632,392 | A * | 5/1997 | Oh | ..... | 220/7 |
| 6,015,056 | A * | 1/2000 | Overholt et al. | ..... | 220/6 |
| 6,820,761 | B1 * | 11/2004 | Mouri et al. | ..... | 220/6 |
| 6,918,502 | B1 * | 7/2005 | Overholt et al. | ..... | 220/6 |
| 7,104,414 | B2 * | 9/2006 | Apps et al. | ..... | 220/6 |
| 7,195,127 | B2 * | 3/2007 | Hsu et al. | ..... | 220/6 |
| 8,261,923 | B2 * | 9/2012 | Blanchard | ..... | 220/6 |
| 2008/0169285 | A1 * | 7/2008 | Marazita et al. | ..... | 220/7 |
| 2009/0194530 | A1 * | 8/2009 | Ringler | ..... | 220/6 |
| 2009/0261092 | A1 * | 10/2009 | Blanchard | ..... | 220/4.27 |
| 2011/0049144 | A1 * | 3/2011 | Koefelda et al. | ..... | 220/6 |
| 2011/0056935 | A1 * | 3/2011 | Samprathi | ..... | 220/6 |
| 2011/0259884 | A1 * | 10/2011 | Kellerer et al. | ..... | 220/6 |
| 2012/0181271 | A1 * | 7/2012 | Dekkers | ..... | 220/4.33 |

FOREIGN PATENT DOCUMENTS

| | | | | | |
|---|---|---|---|---|---|
| EP | 1 655 232 | A | 5/2006 | | |
| EP | 1655232 | A1 * | 5/2006 | ..... | B65D 6/18 |
| WO | WO 2010118758 | A1 * | 10/2010 | ..... | B65D 11/18 |

* cited by examiner

COLLAPSIBLE TRANSPORT AND STORAGE CONTAINER

CROSS-REFERENCES TO RELATED APPLICATIONS

This application is the U.S. National Stage of International Application No. PCT/IB2009/052412, filed Jun. 8, 2009, which designated the United States and has been published as International Publication No. WO 2009/153694 and which claims the priority of Swiss Patent Application, Serial No. 00922/08, filed Jun. 17, 2008, pursuant to 35 U.S.C. 119(a)-(d).

BACKGROUND OF THE INVENTION

The invention relates to a plastic collapsible storage and transport container.

Collapsible storage and transport containers of this type, wherein the sidewalls can be completely collapsed inwardly or outwardly, are known and are also referred to as collapsible boxes. Conversely, folding boxes have foldable end walls and foldable sidewalls with an upper frame enhancing the stability of the folding box. Collapsible containers are frequently used for transporting household items as well as for general storage and transport. Containers with pivotable sidewalls have in common that the pivotable sidewalls are releasably interlocked at their upper edge and lack an upper frame. Stabilization is mostly achieved via hinged two-part covers. Because valuable or sensible goods are transported and such containers particularly in commercial applications, these containers must also be provided with a security device, for example in form of a seal which prevents the container from being opened by unauthorized persons. However, interlocking the sidewalls and sealing the covers with the walls does frequently not prevent unauthorized persons from manipulating or opening the container. Vulnerable locations are typically the interlock of the sidewalls with each other, but also the hinges which hold together, on one hand, the sidewalls with the bottom part and, on the other hand, the covers with the sidewalls. It is then possible at these vulnerable locations to open the container in spite of the seal far enough so that goods can be removed from the container without permission and without any indication of obvious damage of the container or a destroyed seal. Only upon closer inspection would it become apparent that the container was manipulated without permission.

It is therefore an object of the present invention to provide a collapsible storage and transport container of the aforedescribed type with hinges and with an interlock for the sidewalls, which should not be subject to manipulation, should be easy to manufacture and assemble, and facilitate handling of the collapsible storage and transport container.

SUMMARY OF THE INVENTION

This object is attained with a collapsible storage and transport container having a bottom part formed of a bottom plate and a bottom frame having frame sides, and four collapsible sidewalls arranged in an articulated manner on the bottom part so as to be collapsible inwardly onto the bottom part, with two opposing first sidewalls being configured to be releasably locked with the two other opposing second sidewalls in corner regions of the container. At least two first recesses are formed along each frame side and configured to receive connecting elements integrally formed on the first and the second sidewalls, wherein the least two recesses are open inwardly and closed outwardly and have lateral boreholes oriented parallel to the frame sides. A cover is formed of two cover halves which are connected on opposing sidewalls by way of cover hinges. The container also includes means for fixedly locking the cover with the container, and lugs disposed in corresponding first recesses and oriented parallel to bottom edges of the sidewalls, wherein the lugs are rotatable and configured for insertion into the lateral boreholes so as to form a hinged connection between the bottom part and the sidewalls.

A significant advantage of the invention is that the protection against unauthorized opening of the container can be improved by preventing access to the hinges and the interlock of the sidewalls of the container from the outside and therefore also manipulation from the outside. The hinge elements for connecting the sidewalls with the bottom element and the cover, as well as the interlock on the container sidewalls can be easily and quickly installed and exchanged, which saves manufacturing costs of the container.

Additional advantages of the invention are recited in the dependent claims and described in the following description, in which the invention is described in more detail with reference to an exemplary embodiment illustrated in the schematic drawings.

BRIEF DESCRIPTION OF THE DRAWING

It is shown in.

DETAILED DESCRIPTION OF PREFERRED EMBODIMENTS

In the Figures, identical reference symbols are used for identical elements and initial explanations apply to all Figures, unless explicitly stated otherwise.

Figure 1:
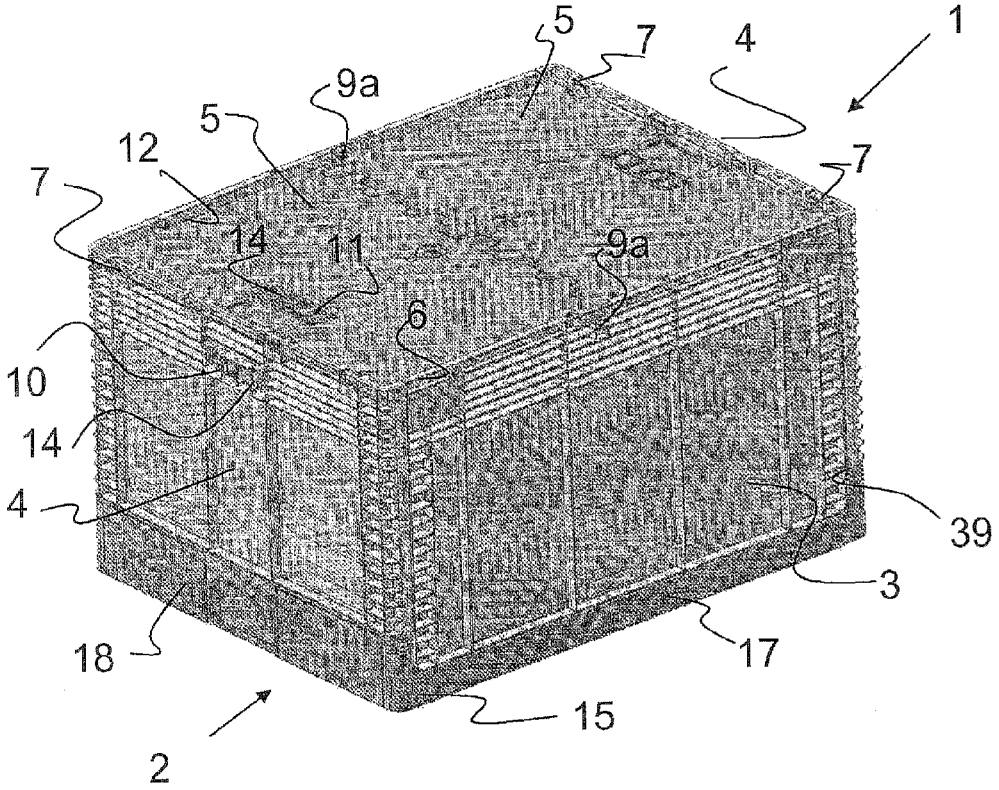
FIG. 1 a perspective view of the collapsible storage and transport container.

FIG. 1 shows the collapsible plastic storage and transport container according to the invention in a perspective view. The container 1 includes a bottom part 2 and four sidewalls 3, 4 which are arranged on the bottom part 2 in an articulated manner and which can be collapsed inwardly. When the container is set up, the articulated joints of the bottom part 2 with the sidewalls 3, 4 are completely covered by the upwardly extending frame 17, 18 of the bottom part 2 and not accessible from the outside. Each of two opposing first sidewalls 3 are releasably locked with the two other opposing sidewalls 4 by way of a lock in the corner regions 6 which can only be operated from the inside. The container 1 is closed with two half-covers 5 which are hinged on opposing sidewalls 4. In the illustrated example, the half-covers 5 are each attached with four hinges 7 on the two second sidewalls 4 which are shorter. However, they can also be hinged on the first sidewalls 3 which are longer. The number of hinges 7 can also be greater or smaller depending on the size of the container. However, the half-covers 5 are advantageously hinged with at least two hinges 7 for each sidewall 4. To open and collapse the container, the two cover halves 5 are opened and swung outwardly by about 270°. The cover halves 5 then contact the outside of the sidewalls 4. For collapsing the container 1, the locks arranged in the upper corner region 6 of the first sidewalls 3 must be unlocked. Thereafter, first the first sidewalls 3 and then the second sidewalls 4 can be collapsed inwardly towards the bottom part 2. The container 1 is set up in the reverse order. First, the second short sidewalls 4 with the hinged half covers 5 are swung up, followed by the second sidewalls 3. By applying a slight outward pressure, the spring-biased lock engages in the corner regions 6 in the adjacent sidewalls 4, whereafter the sidewalls 3, 4 are fixed in place. For closing the container 1, the two half-covers 5 are swung up and placed onto a shoulder 12 on the upper edge 13 of the first sidewalls 3. The covers 5 then rest on the sidewalls 3 below the upper edges 13 of the first sidewalls 3. An opening 9*a* is provided in the cover halves 5, which when the cover halves 5 are closed are located above an opening 9*b* in the sidewall 3 when the cover halves 5 are closed. These openings 9*a*, 9*b* are configured to receive a seal wire, a seal tape or an insertion seal. A grip hole 10, 11 is visible on each of the second sidewalls 4 and on the cover halves 5. These grip holes 10, 11 are arranged so as to be positioned on top of each other when the cover halves 5 are swung outwardly, forming a handle. Braces 14 are arranged in the grip holes 10, 11 to prevent reaching into the interior of the container. The outwardly covered articulated connection of the bottom part 2 with the sidewalls 3, 4 and the interlock of the sidewalls which can only be operated from the inside, as well as the arrangement, design and possibility for closing the covers with a seal increases the security by preventing the container from being opened without authorization.

Figure 2:
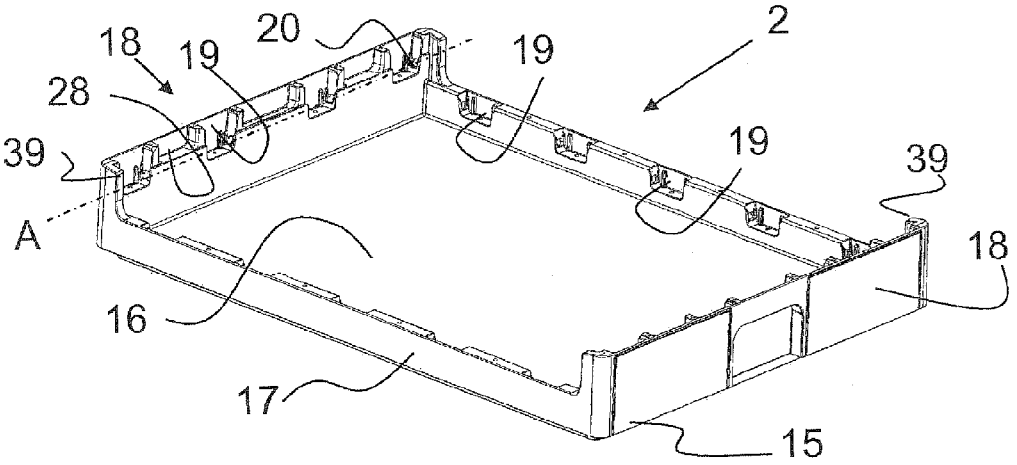
FIG. 2 a perspective view of the bottom part of the container.

FIG. 2 shows the bottom part 2 in a perspective view. The bottom part 2 has a bottom frame 15 and a bottom plate 16. The bottom plate 16 together with the bottom frame 15 can be constructed as a single-piece bottom part 2. In another embodiment, the bottom part 2 may be constructed in two pieces, wherein the bottom plate 16 can be inserted in the bottom frame. The frame 15 has recesses 19 in its longitudinal and transverse sides 17, 18, which are open to the inside and closed to the outside. Lateral boreholes 20 which extend parallel to the longitudinal and transverse sides 17, 18 of the frame are disposed in the recesses 19. These recesses 19 are designed to receive the connecting elements 21 formed on the sidewalls 3, 4. The connecting elements 21 have lugs 22 which extend parallel to the bottom edge of the sidewalls 3, 4 and which can be inserted in the lateral boreholes 20 of the recess 19 and rotated such that the lugs 22 inserted in the boreholes 20 form a hinge-like connection between the bottom part 2 and the sidewalls 3, 4. The transverse sides 18 of the bottom frame 15 have additional approximately U-shaped recesses 28 which are open to the inside and covered to the outside, which are designed to receive tabs 30 formed on the lower edges of the second sidewalls 4. The longitudinal sides 17 and the transverse sides 18 of the bottom frame 15 have different heights. When the container 1 is collapsed, the first sidewalls 3 arranged on the two longitudinal sides 17 of the frame 15 are collapsed inwardly first and rest inside the bottom frame 2 on the bottom plate 16. Subsequently, the second sidewalls 4, which are connected with the upper transverse sides 15 in an articulated manner, are also collapsed inwardly. The height of the transverse sides 15 is selected so that the collapsed second sidewalls 4 lie flat on the first sidewalls 3. As a result, the collapsed container 1 is now in form of a compact, easy to handle block of superpositioned cover halves 5 and sidewalls 3, 4. The container 1 is set up, as already described above, in the reverse order, wherein initially the second sidewalls 4 are raised, followed by the first sidewalls 3. To prevent the already raised second sidewalls 4 from collapsing again when the first sidewalls 3 are raised, a tilt inhibition is provided on the bottom part 2. For this purpose, the vertical distance from the pivot axis "A" to the top edge 39 at the transition from the shorter side of the bottom frame 18 to the longer side 17 of the bottom frame 15 is slightly greater than the distance from the pivot axis "A" to the bottom edge 39' of the second sidewall 4. The pivot axis "A" is here the imaginary axis about which the sidewalls 4 of the container 1 are pivoted when being opened and closed. When the sidewall 4 is raised, the bottom edge 39' of the sidewall 4 frictionally contacts the top edge 39 of the bottom part 2. This friction prevents the sidewall 4 from unintentionally collapsing again. The outer part of the bottom part 2, which is not visible in the drawing, can have ribs to provide reinforcement and may also have an additional cover for attaining a smooth bottom side. The bottom side of the bottom part 2 and of the bottom frame 15, respectively, is constructed complementary to the top side of the container, so that the containers 1 can be stacked on top of each other skid-proof. To this end, the bottom side of the bottom frame 2 has correspondingly designed recesses configured to receive the top edges of the sidewalls 3, 4 of the container 1. The container volume can be increased by placing a container 1 with its bottom frame 15, but without a bottom plate 16, on top of a container 1 without a cover 5. The two containers are secured to each other via U-shaped connecting elements. These connecting elements are inserted laterally from the outside into the bottom frame 15 and into the upper region of the sidewalls 3, 4 and secured inside the container 1 against unauthorized removal. In this version, the covers 5 and the seals are arranged on the other container.

Figure 3:
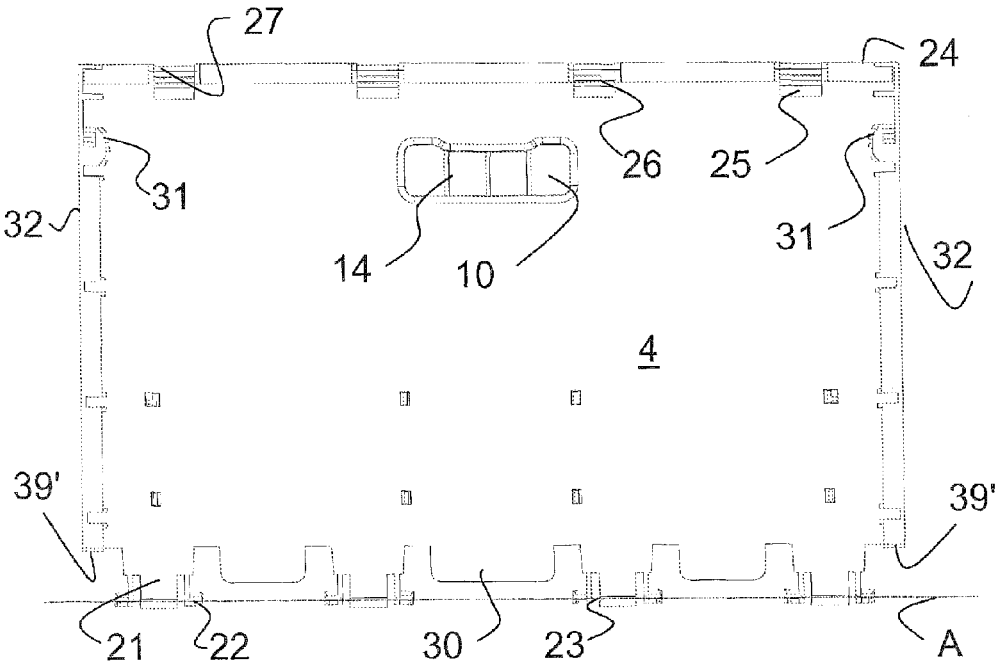
FIG. 3 a second sidewall of the container, viewed from the inside.

FIG. 3 shows a short sidewall 4 of the container 1. The connecting elements 21 formed below on the sidewall 4 with the lugs 22 extending on both sides parallel to the bottom edge of the sidewall 4 can be clearly seen. The connecting elements 21 have a slotted opening 23. The lugs 22 are then movable along the pivot axis 'A' with a slight spring action. In addition to the connecting elements 21, the tabs 30 formed on the bottom edge of the second sidewall 4 are visible, which engage with the U-shaped recesses 28 of the transverse sides 18 of the bottom frame 15, when the sidewall 4 is arised, thereby giving the sidewalls 4 of the container 1 additional support and stability. Recesses 25 with hinge axes 26, which extend parallel to the top edge 24, for the cover hinges 7 are provided on the top edge 24 of the sidewall 4. The recesses 25 for the cover hinges 7 are covered at the top 27, so that the hinge 7 is partially covered to the outside and protected from manipulation. In addition, the grip hole 10 with the braces 14 is visible in the upper region of the sidewall. The shape of the grip hole 10 is ergonomically designed, with rounded edges, to make it easier to pick up and carry the container 1. The detents 31 are visible on the two lateral edges 32 of the second sidewall 4, in which the locking projections of the interlock arranged in the upper corner region 6 of the first sidewalls engage during locking.

Figure 4:
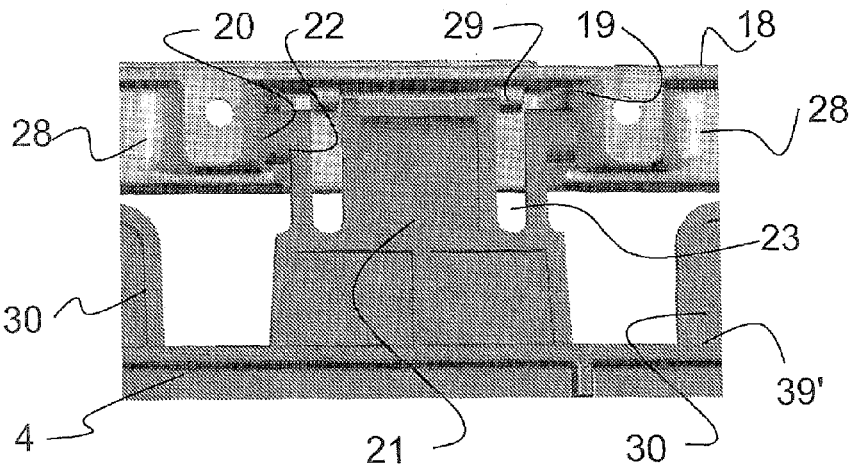
FIG. 4 a detail of the bottom frame with articulated second sidewall in a perspective view, viewed from above.

FIG. 4 shows a detail of a transverse side 18 of the bottom frame 15 with an articulated sidewall 4 in a prospective diagram, as viewed from above. The connecting element 21 with the lug 22 formed thereon engages in the boreholes 20, thereby pivotally supporting the connecting elements 21 and hence the sidewalls 4 in the bottom frame 15. The vertically extending protrusions 29 are visible in the recess 19, which engage in the recesses 23 of the connecting elements 21 when the sidewall is raised, thereby preventing the lugs 22 from moving along the pivot axis "A". These protrusions 29 prevent the lugs 22 from being pushed or pulled out of the boreholes 20 through manipulation or improper handling of the container 1 or the sidewalls 3, 4. The connecting elements 21 and the configuration of the recesses 19 receiving the connecting elements 21 are identical for the first and the second sidewalls 3, 4. The sidewalls 3, 4 are mounted by inserting the connecting elements 21 into the recesses 19 in a horizontal orientation of the sidewall, i.e., parallel to the bottom part 2, and moving them towards the bottom part 2. The protrusions 29 thereby do not yet engage in the recesses 23. Because the recess 19 of the bottom frame 15 is wider at the top edge than in the bottom region, the lugs 22 are slightly pushed towards the connecting element 21 when the connecting elements 21 are inserted in the recess 19, until the lugs 22 reach the borehole 20 and latch therein. Radially outwardly oriented cams are arranged on the front ends of the lugs. The boreholes 20 have recesses with an orientation which allows the lugs 22 with the cams to latch in the boreholes 20 only in a predefined position, namely when the sidewalls 3, 4 are oriented parallel to the bottom part 2. The lugs 22 can then also be pushed out of the boreholes 20 only in the horizontal position of the sidewall 3, 4. Tabs 30 formed on the lower edge 39' of the second sidewall 4 next to the connecting elements 21 are also illustrated, with the tabs 30 engaging in the recesses 28 when the sidewalls 4 are open, providing additional stability to the second sidewalls 4. The connecting element 21 together with the recess 19 and its shape form a hinge-like connection between the sidewalls 3, 4 and the bottom part 2 and the bottom frame 15, respectively, namely a bottom-sidewall hinge. The sidewalls 3, 4 are installed by simply inserting the sidewalls 3, 4, i.e., without additional tools, which significantly facilitates assembly and replacement of defective sidewalls and lowers the manufacturing costs.

Figure 5A:
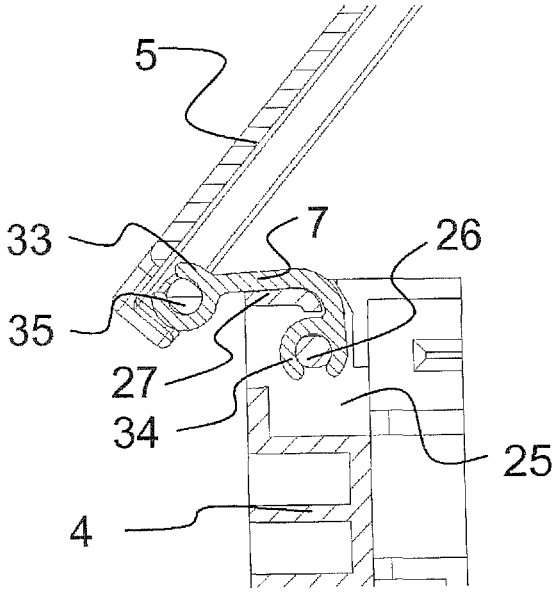
FIG. 5A a detail of a sidewall with articulated, partially opened cover in a cross-sectional view.
Figure 5B:
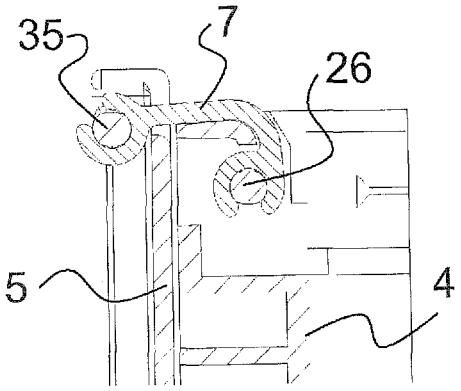
FIG. 5B a detail of a second sidewall with articulated, fully opened cover in a cross-sectional view.
Figure 5C:
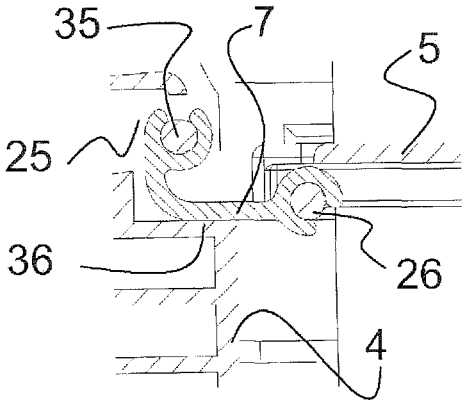
FIG. 5C a detail of a sidewall with articulated, closed cover in a cross-sectional view.

FIGS. 5A to 5C show a detail of a second sidewall 4 with a hinged cover half 5A. In cross-sectional views for different cover positions. The cover hinge 7 is constructed of a plate with a substantially J-shaped cross-section and with slotted tube sections 33, 34 formed at the ends. The tube sections are designed to receive hinge axes 35, 26. The cover hinge 7 then has two rotational or pivot axes, allowing rotation of the half covers 5 by 270°, so that these rest against the outside of the second sidewall 4 after being opened. The distance between the two tube sections 33, 34 is selected such that with the cover hinge 7 open, the hinge axis 35 of the half cover 5 and the tube section 33, respectively, is located so far outside the second sidewall 4 that the half cover 5 can be rotated outwardly without interference. The cover hinge is installed without tools. The slots in the tube sections 33, 34 in the cover hinge 7 have a smaller width than the diameter of the hinge axes in the half cover 35 and the diameter of the hinge axis 26 in the sidewall 4. The hinge axes are slightly flattened at the top and bottom side, so that the tube section 33, 34 can be placed on the corresponding axis 25, 26 only in a certain position with respect to the associated axis 25, 26.

In FIG. 5A, the cover hinge 7 is completely open and the cover half 5 is raised. Also illustrated is the segment of the sidewall 4 with the recess 25 designed to receive the cover hinge 7 and the cover 27 of the recess 25. In illustrated position of the cover, the hinge plate of the cover hinge 7 rests on the cover 27 and the cover half 5 can be opened further until the half cover 5 is completely open and contacts the outside of the sidewall 4. This position is illustrated in FIG. 5B. FIG. 5C shows the hinge position when the half cover 5 is closed. The hinge plate of the cover hinge rests on the lower edge 36 of the recess 25 for the cover hinge 7.

Figure 6:
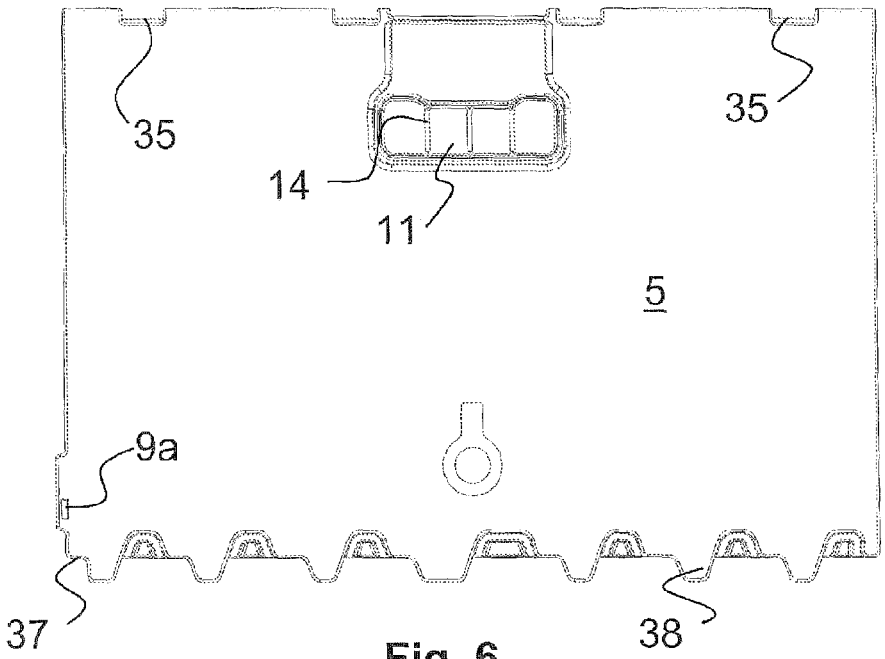
FIG. 6 a half-cover of the container, viewed from above.

FIG. 6 illustrates a half cover 5 of the container 1. The front edge 37 of the half covers 5, in the Figure the lower edge, has complementary serrated edges 38 which, when installed, engage with each other in the closed state, thereby providing stability to the cover. Due to the symmetry and complimentary construction, the two half covers 5 can be interchanged. The hinge axes 35 are visible on the rear edge of the half cover 5. The grip hole 11 is arranged in the rearward region of the half cover 5 with the braces 14 such that the grip hole 11 is positioned exactly in front of the grip hole 10 in the second sidewall 4 when the cover is open.

Figure 7:
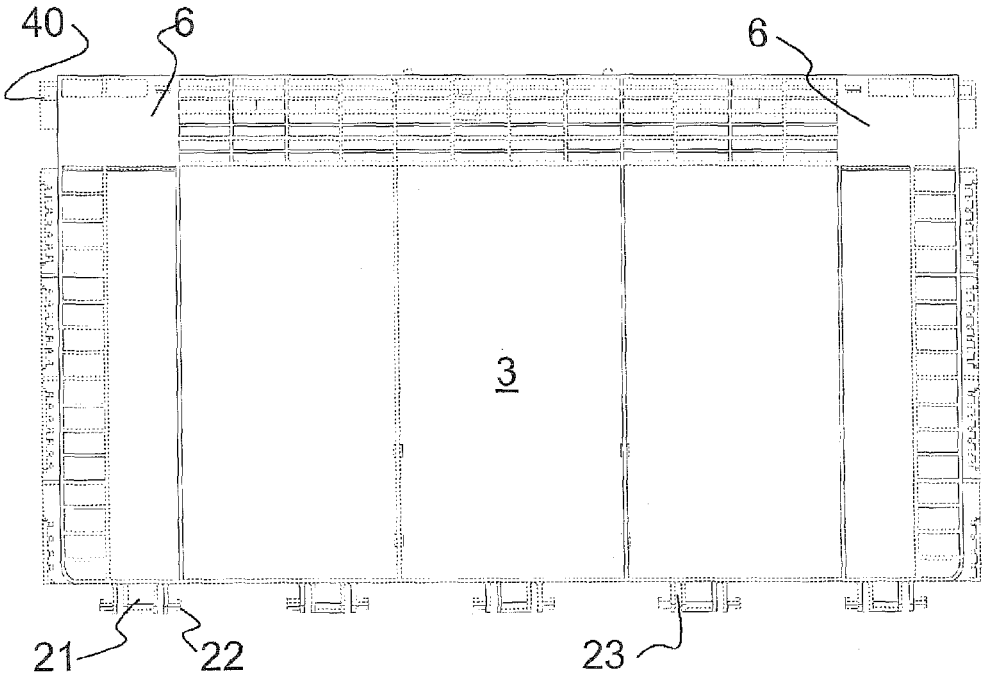
FIG. 7 a first sidewall of the container, viewed from the outside.

FIG. 7 shows a long sidewall 3 of the container 1 viewed from the outside. The first sidewall 3 has in the upper corner region 6 a double-walled section 6 configured to receive the catch bolt 4 for interlocking adjacent sidewalls 3, 4 of the container 1. The outside is formed in this corner region 6 by a closed surface. The first sidewall 3 is reinforced in the upper edge region by a corrugation. In another embodiment, the corrugation can be additionally reinforced by welding a plate. The first sidewall 3 is connected with the connecting elements 21 in the same manner as the second sidewall 4 is attached in an articulated manner on the bottom frame 15.

Figure 8:
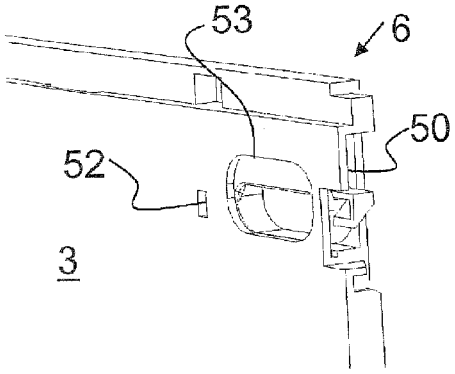
FIG. 8 a detail of an upper corner region of the first sidewall of the container with the interlock in a perspective diagram, viewed from the inside.

FIG. 8 shows a detail of the upper edge region 6 of the long sidewall 3 of the container 1 as seen from the inside in a perspective view. Catch bolts 40 are arranged in these upper corner regions 6 of the opposing sidewalls 3, wherein the catch bolts 40 can be releasably locked with the two other opposing sidewalls 4 by way of the catch bolts 40. The recesses formed by the inner and outer side faces of the double-walled section 6 of the sidewall 3 are configured to receive the catch bolt 40.

Figure 9:
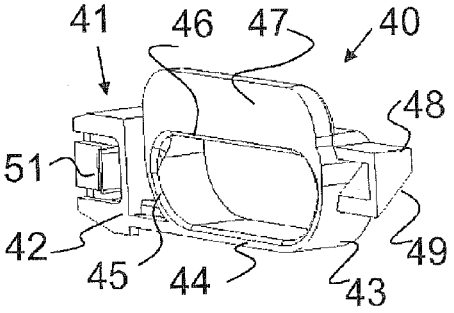
FIG. 9 a catch bolt in a perspective diagram, viewed from the inside.

FIG. 9 shows a catch bolt 40 in a perspective view with the inside facing to the front. The catch bolts 40 are constructed as spring clips 40, wherein each spring clip 40 has an end 41 which is to be fixedly connected with the sidewall 3 of the container 1. This end 41 of the spring clip 40 is formed by an integrally formed catch element 42 to be received in a complimentary recess in the sidewall 3. A handle element 44 is formed in one piece on the spring clip 40 in the center region of the spring clip 40 between the catch element and the free end 43. The grip element 44 is essentially formed by an oval operating handle 45 with rounded bead-shaped edges 46, with a bezel 47 extending upwardly and parallel to the sidewall 3. A locking projection 48 configured to engage with a detent 31 disposed on the second sidewall 4 is formed on the free end 3 of the spring clip 6. The locking projection 48 has an inclined surface 49. When a first sidewall 3 is raised, its spring clip 40 is lifted through the detent 31 of a second sidewall 4, which runs up on the locking projection 48, against the spring force of the spring clip 40 and by building up restoring forces. Due to the spring force of the spring clip 40, the locking projection 48 of the sidewall 3 latches in the upright position of the sidewall 3 behind the detent 31 of the sidewall 4, thereby interlocking the sidewalls 3, 4 with each other. The catch bolt 40 is installed by inserting the catch bolt 40 from the front side 50 of the sidewall 3 into the recess until the catch element 42 latches in the provided complimentary recess. The locking tab 51 of the catch element 42 latches in the recess 52 in the inner sidewall, holding the end of the spring clip 40. The inside face of the first sidewall 3 has in the region of the double-walled section a grip hole 53. The opening is selected so that during maximum pull on the handle 45, the locking projection 48 is moved upward until it disengages from the detent 31 of the sidewall 4 and the sidewall 3 can be collapsed. A bezel 47 formed on the handle is configured to cover the recess 53 above the handle 45, so that the cavity in the double-walled region of the sidewall 3 is closed to prevent grasping behind the recess.

Figure 10:
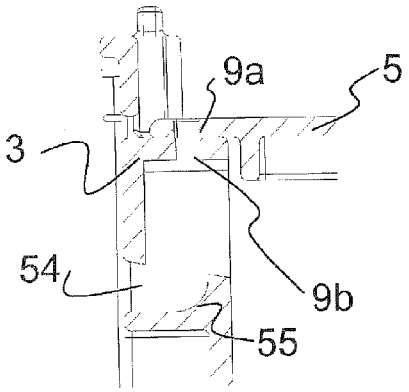
FIG. 10 a detail of a first sidewall with closed cover in the region of the openings provided for sealing the container, without a seal, in a cross-sectional view.

FIG. 10 shows in a cross-sectional view a detail of a first sidewall 3 with a closed cover 5 in the region of the openings 9*a*, 9*b* provided for the seals of the container 1, however without a seal. The opening 9*a* is arranged in the cover so as to be located above the recess 9*b* in the first sidewall 3*a* of the container 1, when the cover 5 is closed. The recess 9*b* which extends vertically in the sidewall 3 terminates in an opening on the outside of the sidewall 3. A seal wire or a seal tape can then be pulled through the opening 9*a* in the cover 5 and further through the recess 9*b* and opening 45 and sealed from the outside. To simplify insertion of the seal tape or the seal wire, the recess 9*b* has in the sidewall towards the opening 54 a curvature 55 for guiding the seal tape. Because both first sidewalls 3 and both half covers 5 are constructed identically, the container 1 has two seals.

Figure 11:
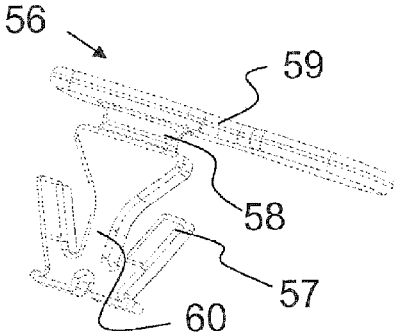
FIG. 11 an insertion seal for the container in a perspective view.

The recess 9*b* in the sidewall 3 is constructed so that the container 1 can also be sealed with an insertion seal 56. Such insertion seal 56 is shown in FIG. 11 in a perspective view. The insertion seal 56 is constructed of a seal cover 59 and an insertion part 60 with expansion elements 57. The insertion part 60 with the seal cover 59 is connected with the insertion part by way of a neck section 58. The neck section 58 is constructed as a rated breakpoint.

Figure 12:
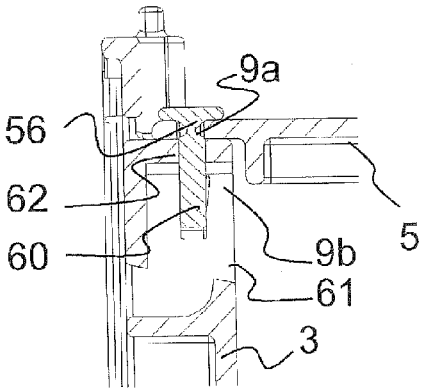
FIG. 12 a detail of a first sidewall with closed cover in the region of the openings provided for sealing the container, with an insertion seal, in a cross-sectional view.

FIG. 12 shows in a cross-sectional view a section of a first sidewall 3 with a closed cover 5 in the region of the openings 9*a*, 9*b* provided for applying seals to the container 1, with an inserted insertion seal 56. The recess 9*b* in the first sidewall 3 has an upwardly facing opening 62 of smaller width than the recess 9*b* itself. When the insertion seal 56 is inserted into the opening 62 of the recess 9*b*, the expansion elements are compressed; when the insertion part 60 of the seal 56 is completely inserted into the recess 9*b*, the expansion elements expand, so that the seal 56 can no longer be pulled out of the recess 9*b* without being damaged.

Figure 13:
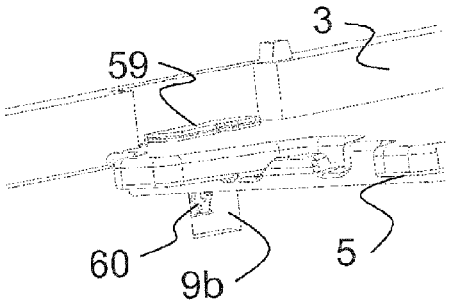
FIG. 13 a detail of a first sidewall with closed cover in the region of the openings provided for sealing the container, with a seal, in a perspective view.

A detail of the container 1 in the region of the seal 56 is illustrated in FIG. 13 in a perspective view. The recess 9*b* in the sidewall 3 is open to the inside. To open the sealed container 1, the seal 56 must first be destroyed. By pulling on the seal cover 59, the seal cover 59 is torn from the insertion part 60 at the rated breakpoint. The seal cover 59 can be removed and the insertion part 60 drops into the interior of the container through the opening 61 disposed in the recess 9*b*. After both seals 56 have been removed from the container, the half covers 5 can be opened without interference.

The collapsible storage and transport container 1 is substantially secure against manipulation as a result of the hinged connection of the sidewalls 3, 4 with the bottom part 2, which is covered from the outside, and the largely covered and externally inaccessible cover hinges 7, as well as a result of the interlock 40 of the sidewalls 3, 4 with each other, which can only be operated from the inside. The connection between the sidewalls 3, 4 and the bottom part 2 has no additional parts, with the sidewalls 3, 4 being connected with each other only through assembly. The cover hinge can also only be placed on the sidewalls and the covers and does not require additional installation means. This simple handling and assembly of the container reduces manufacturing costs and simplifies the exchange of defective parts.

What is claimed is:

1. A collapsible plastic storage and transport container comprising:

a bottom part formed of a bottom plate and a bottom frame having frame sides, four collapsible sidewalls arranged in an articulated manner on the bottom part so as to be collapsible inwardly onto the bottom part, with two opposing first sidewalls being configured to be releasably locked with the two other opposing second sidewalls in corner regions of the container, at least two first recesses formed along each frame side and configured to receive connecting elements integrally formed on the first and the second sidewalls, the at least two first recesses having a bottom side, a back side, vertical walls and a front opening so as to be open inwardly and closed outwardly and having lateral boreholes which extend from the vertical walls parallel to the frame sides of the bottom part, at least one cover formed of two cover halves and connected on opposing sidewalls by way of cover hinges, a seal fixedly locking the cover with the container, lugs with an unobstructed front end extending laterally from the connecting elements parallel to bottom edges of the sidewalls, the lugs being rotatable with respect to the sidewalls about a pivot axis and configured for insertion into the lateral boreholes only when a major plane of the sidewalls is parallel to the bottom plate of the bottom part, so as to form in an assembled state a hinged connection between the bottom part and the sidewalls, and protrusions extending vertically from the bottom side along the back side of the first recesses, said protrusions engaging in an upright position of the four sidewalls with second recesses vertically formed in the connecting elements and preventing the lugs from being pushed into or pulled out of the boreholes when the sidewalls are in the upright position, wherein the first recesses in the frame sides are wider at an upper edge than in a lower region, wherein radially outwardly oriented cams on front ends of the lugs and wherein the boreholes have third radially inwardly arranged recesses which are oriented such that the lugs with the cams latch in the lateral boreholes only when the sidewalls are oriented parallel to the bottom part.

2. The container of claim 1, wherein the bottom part comprising the bottom plate and the bottom frame is formed as one-piece.

3. The container of claim 1, characterized in that the bottom plate is constructed to be inserted in the bottom frame.

4. The container of claim 1, wherein the bottom frame additionally comprises approximately U-shaped fourth recesses formed in the frame sides, which are open inwardly and covered outwardly, and which are configured to receive tabs formed on lower edges of the second sidewalls.

5. The container of claim 4, wherein the bottom frame comprises longitudinal sides and transverse sides, with a height of the longitudinal sides being smaller than a height of the transverse sides.

6. The container of claim 5, wherein the bottom frame has a tilt inhibition formed by a top edge disposed at a transition from a transverse side to a lower longitudinal side of the bottom frame, wherein a distance from a pivot axis to a bottom edge of the second sidewall is smaller than a distance from the top edge to the pivot axis.

7. The container of claim 1, wherein the second sidewalls and the cover halves comprise grip holes having braces, wherein the grip holes are located on top of one another when the cover halves are open.

8. The container of claim 1, wherein the cover hinges comprise a plate with a substantially J-shaped cross-section and with slotted tube sections formed at respective ends, with each of a first tube section being constructed to receive a hinge axis of a cover half and a corresponding second tube section being constructed to receive a hinge axis of the second sidewall.

9. The container of claim 1, wherein a first sidewall has a double-walled section located in an upper corner region and having a closed outside surface, further comprising a catch bolt disposed on an adjacent sidewall for interlocking the adjacent sidewall with the first sidewall by inserting and securing the catch bolt in the double-walled section.

10. The container of claim 9, wherein the catch bolt is formed as a spring clip having a fixed end connected with a complementary recess in a first sidewall and formed by an integrally formed catch element, with the spring clip comprising a handle element formed as a single piece in a center region of the spring clip between the catch element and a free end of the spring clip, wherein the free end of the spring clip has a locking projection configured for engagement in a detent arranged on a second sidewall.

11. The container of claim 1, wherein a cover half has an opening arranged so as to be located above a fourth recess disposed in a first sidewall of the container, with the cover closed, wherein the fourth recess extends vertically in the first sidewall and terminates in an opening disposed on an outside of the first sidewall, and wherein the opening in the cover half and the fourth recess in the first sidewall are configured to receive a seal.

12. The container of claim 11, wherein the fourth recess disposed in a first sidewall has a curvature in a direction towards the opening disposed on the outside of the first sidewall.

13. The container of claim 11, wherein the seal is an insertion seal or a tape seal.

* * * * *